US006567492B2

(12) United States Patent
Kiselev et al.

(10) Patent No.: US 6,567,492 B2
(45) Date of Patent: May 20, 2003

(54) PROCESS AND APPARATUS FOR PRODUCTION OF F-18 FLUORIDE

(75) Inventors: Maxim Y. Kiselev, Sterling, VA (US); Duc Lai, Chantilly, VA (US)

(73) Assignee: Eastern Isotopes, Inc., Sterling, VA (US)

( * ) Notice: Subject to any disclaimer, the term of this patent is extended or adjusted under 35 U.S.C. 154(b) by 0 days.

(21) Appl. No.: 09/878,770

(22) Filed: Jun. 11, 2001

(65) Prior Publication Data

US 2003/0007588 A1 Jan. 9, 2003

(51) Int. Cl.[7] ..... G21G 1/10
(52) U.S. Cl. ..... 376/195; 376/190
(58) Field of Search ..... 376/195, 194, 376/190

(56) References Cited

U.S. PATENT DOCUMENTS

| | | | | |
|---|---|---|---|---|
| 3,981,769 | A | 9/1976 | Winchell et al. | 176/11 |
| 4,436,717 | A | 3/1984 | Shiue et al. | 424/1.1 |
| 4,818,468 | A | 4/1989 | Jungerman et al. | 376/195 |
| 5,037,602 | A | 8/1991 | Dabiri | 376/198 |
| 5,082,980 | A | 1/1992 | Berridge | 568/917 |
| 5,223,434 | A | 6/1993 | Kanno et al. | 436/56 |
| 5,280,505 | A | 1/1994 | Hughey et al. | 376/156 |
| 5,384,113 | A | 1/1995 | Deutsch et al. | 424/1.69 |
| 5,425,063 | A | 6/1995 | Ferrieri et al. | 376/195 |
| 5,436,325 | A | 7/1995 | Johnson et al. | 536/4.1 |
| 5,468,355 | A | 11/1995 | Shefer et al. | 204/157.2 |
| 5,482,865 | A | 1/1996 | Ferrieri et al. | 436/56 |
| 5,573,747 | A | 11/1996 | Lacy | 424/1.65 |
| 5,586,153 | A | 12/1996 | Alvord | 376/196 |
| 5,759,513 | A | 6/1998 | Nakazawa | 424/1.11 |
| 5,770,030 | A | 6/1998 | Hamacher et al. | 205/43 |
| 5,917,874 | A | 6/1999 | Schlyer et al. | 376/194 |
| 5,932,178 | A | 8/1999 | Yamazaki et al. | 422/159 |
| 6,027,710 | A | 2/2000 | Higashi et al. | 424/1.65 |
| 6,066,309 | A | 5/2000 | Zamora et al. | 424/1.49 |
| 6,172,207 | B1 | 1/2001 | Damhaut et al. | 536/18.4 |
| 6,261,536 | B1 | 7/2001 | Zamora et al. | 424/1.49 |

FOREIGN PATENT DOCUMENTS

| | | | | |
|---|---|---|---|---|
| EP | 0 462 787 | B1 | 6/1995 | A61K/51/00 |
| EP | 0 798 307 | A1 | 1/1997 | C07H/5/02 |
| EP | 0 949 632 | A2 | 10/1999 | G21G/1/10 |
| JP | 09 054196 | A | 6/1997 | G21G/1/10 |

OTHER PUBLICATIONS

Linder et al., "A Dynamic 'Loop' Target for the In–Cyclotron Production of F–18", 1973, Pergamon Press, Int. J. Appl. Radiat. Isot., vol. 24. pp. 124–126.*

Iwata et al., "[18F]Fluoride Production with a Circulating [18O]Water Target" (1987), Pergamon Journales Ltd., Applied Radiation and Isotopes vol. 38, No. 11, pp. 979–984.*

Helmeke et al., "A water target with beam sweep for routinge fluorine–18 production" (2001), Elsevier Science Ltd., Applied Radiation and Isotopes vol. 54 (5), pp. 753–759.*

(List continued on next page.)

*Primary Examiner*—Michael J. Carone
*Assistant Examiner*—Daniel Matz
(74) *Attorney, Agent, or Firm*—Mark Douma

(57) ABSTRACT

A process and apparatus for producing the $^{18}F$ isotope from water enriched with the $^{18}O$ isotope using high energy protons from a cyclotron. The apparatus has a cyclotron target cavity that is connected to a fluid loop that contains a water reservoir, pump, and pressure regulator. Water is continuously recirculated through the target cavity to increase reliability. After irradiation long enough to produce a desired amount of $^{18}F$, water in the target loop is diverted through an $^{18}F$ extraction device before being returned to the target loop. The returning water may also be purified and additional water added to the target loop as needed to permit continuous irradiation and production of $^{18}F$.

15 Claims, 4 Drawing Sheets

OTHER PUBLICATIONS

Solin et al., "Production of 18F from Water Targets. Specific Radioactivity and Anionic Contaminants" (1988), Pergamon press, Applied Radiation and Isotopes vol. 39, No. 10, pp. 1065–1071.*

Hamacher et al., "Computer–aided Synthesis (CAS) of No–carrier–added 2–[18F]Fluore–2–deoxy–D–glucose" (1990), Pergamon press, Applied Radiation and Isotopes vol. 41, No. 1, pp. 49–55.*

F. Fuchtner et al., "Basic Hydrolysis of 2–[18F]Fluoro–1,3, 4,6–tetra—O–acetyl–D–glucose in the Preparation of 2–[18F]Fluoro–2–deoxy–D–glucose," Appl. Radiat. Isol., vol. 47, No. 1, pp. 61–66 (1996).

E. J. Knust et al., "High Yield Production of 18–F in a Water Target via the 18–O(3–He,p)18–F Reaction," Int. J. Appl. Radiat. Isot., vol. 34, No. 12, pp. 1627–1628, (1983).

O.T. DeJesus et al. "[18–F] Fluoride from a Small Cyclotron for the Routine Synthesis of [18–F] 2–Fluoro–2–Deoxy–D–Glucose," Appl. Radiat. Isot., vol. 37, No. 5, pp. 397–401 (1986).

E. J. Knust et al. "Production of Flourine–18 Using an Automated Water Target and a Method for Fluorinating Aliphatic and Aromatic Compounds," Appl. Radiat. Isot., vol. 37, No. 8, pp. 836–836 (1986).

Jean–Luc Morelle et al, "An Efficient [18F]Fluoride Production Method Using a Recirculating 18–O Water Target," Proc. 3rd Workshop on Targetry and Target Chem., Vancouver, B.C., pp. 50–51 (1986) at www.triumf.ca/wttc/pdf/1989/Sec4–4.pdf.

Mulholland GK, Hichwa RD, Kilbourn MR, Moskwa J, A Reliable Pressurized Water Target for F–18 Production at High Beam Currents. J Labelled Cmpds Radiopharm, vol. 26, pp. 192–193 (1989).

M. Sajjad et al., "Cyclotron Targetry for Medical Isotope Production," Nuclear Instruments and Methods in Physics Research B40/41 (1989), pp. 1100–1104.

C. W. Alvord et al., "Target System for the RDC–111 Cyclotron," Proc. 6th Workshop on Targetry and Target Chem., Vancouver, B.C., pp. 155–161 (1995).

M. R. Kilbourn et al., "A Simple [18O] Water Target for [18F] Production," *Int. J. Appl. Radiat. Isot.*, vol. 35, No. 7, pp. 599–602 (1984).

M. R. Kilbourn et al., "An Improved [18O] Water Target for [18F] Fluoride Production," *Int. J. Appl. Radiat. Isot.*, vol. 36, No. 4, pp. 327–328 (1985).

T. J. Tewson et al., "Routine Production of Reactive Fluoride–18 Fluoride Salts From an Oxygen–18 Water Target," *Nucl. Med. Biol.*, vol. 15, No. 5, pp. 499–504 (1988).

R. D. Hichwa et al., "Design of Target Systems for Production of PET Nuclides," *Nuclear Instruments and Methods in Physics Research*, vol. B40/41, pp. 1110–1113 (1989).

* cited by examiner

PROCESS AND APPARATUS FOR PRODUCTION OF F-18 FLUORIDE

BACKGROUND

1. Technical Field

The invention relates to production of an $^{18}F$ radioisotope by means of proton irradiation of $^{18}O$ enriched water.

2. Background

The $^{18}F$ isotope (hereinafter, F-18 isotope or F-18) has become widely used in nuclear medicine for diagnostic studies using a Positron Emission Tomography (PET) body scanning technique. The F-18 is typically used to label an injectable glucose derivative. Because of its short half-life (109 min), this isotope must be used as soon as possible after production. This makes it impossible to accumulate a sufficient quantity for delayed use. Therefore, work shifts usually start near midnight with production for distant (via automobile) hospitals first, followed by that for nearby hospitals in the very early morning. Any shortage in production has an immediate and direct effect on users. As a result, reliability and predictability of production are extremely important for users as well as suppliers of this isotope.

The two main methods of producing F-18 use an $^{18}O(p, n)^{18}F$ reaction in a cyclotron. Both gaseous oxygen and liquid water enriched with $^{18}O$ (hereinafter, O-18) have been used as target materials. However, the gaseous approach is very difficult in practice because the F-18 is very reactive and hard to recover from a gaseous medium. The overwhelming majority of production facilities use water enriched with O-18($H_2[^{18}O]$, hereinafter, O-18 water).

Using O-18 water is not without problems, also. For production efficiency, it is desirable to use water that is as much enriched as possible. However, 95% enriched O-18 water costs approximately $150 per ml. Also, PET has been gaining greater acceptance and the building of new O-18 water production facilities is lagging behind demand. The cost pressures make conservation and reuse of the O-18 water target material even more important.

In a typical system for F-18 production, the target is typically loaded with a pre-determined amount of O-18 water by means of a syringe or pump. The volume of water in the target is about 0.8 ml, but another 1–2 ml is required to fill the lines leading to the target. The water delivery system is then isolated from the target by means of a valve and the target is irradiated. This can be described as a "static" target, meaning that the target material remains in the target throughout the irradiation time.

The irradiated water is then removed from the target, typically by means of inert gas pressure, and transported over a delivery line leading outside the cyclotron shielding to a collection vial about 25 feet (8 m) from the target. The F-18 isotope is then separated from the water and processed for production of a radiopharmaceutical agent.

A considerable amount of O-18, typically 25–30%, is lost after each run. The O-18 isotope is used up in three ways. First, a very small amount, on the order of nanoliters, is actually converted to F-18. The next most important loss of O-18 is due to a combination of leakage and isotopic exchange with $^{16}O$ oxides in the target, transport lines and storage vessels. After one run of an hour or two, the enrichment factor can drop from 95% to 85–90%. This is still high enough to be economical to run a cyclotron, but the amount of contamination is too high, as will be explained below. (As the enrichment factor falls, the irradiation time increases. 80% is a minimum under current economic conditions.)

The third loss is due to leakage of target material from the pressurized target and attached tubing which may lead to a reduced water level in the target and, if severe enough, to a catastrophic failure. Target cooling relies on the liquid water material present in the target to function as a heat conductor. A typical 1 ml target must dissipate over 500 W of heat for as long as 2–3 hours. Many target systems are pressurized to as high as 500 psig or higher to improve target thermal stability. In these conditions, containment of a small amount of water becomes a significant technical problem. Loss of a very small amount of target material may have dramatic consequences such as target foil rupture, target body degradation, and loss of target yield.

Although 70–75% of the initial O-18 water remains, the biggest effective loss is due to contamination. Any contamination in the liquid water increases the formation of superheated steam with increased leakage and loss of cooling. Because the consequences are so adverse, the water recovered after only one run in a static target system must be sent back to the supplier for reprocessing to remove contaminants.

Existing static target systems do not provide any mechanism to timely detect the critical loss of target material during irradiation. In addition, in a static target it is impossible to monitor the amount of radioactive F-18 being produced with any certainty. The result of a production run may not be known until after its completion, up to several hours after start of production. Given the fact that production and delivery schedules do not allow much flexibility due to the extremely short half-life of the F-18, this uncertainty results in a decrease in reliability and availability of the product.

SUMMARY

Accordingly, one objective of the invention is to increase the reliability of the production of F-18 from O-18 enriched water irradiated by high energy protons produced by a cyclotron. Further objectives are to increase the efficiency so that the cyclotron can be irradiating O-18 without interruption. Still another objective is to continually reuse O-18 water from which F-18 is periodically extracted. Another objective is to be able add additional new O-18 water as it is lost due to system leakage and the like so that the system can run for an extended period without interruption.

These objectives and more are realized with a process that continuously recirculates O-18 enriched water through a target loop that includes a target cavity for a cyclotron that irradiates the target cavity with protons to convert a portion of O-18 to F-18.

Longer irradiation without failure is achieved by using a combination of one or more of the following: maintaining a pressure of at least about 250 psig in the target cavity; recirculating the O-18 water through the target cavity at least about once every two minutes; and maintaining an O-18 water volume in the target loop that is at least about ten times the volume of the target cavity, itself. Additional benefit can be obtained by substantially cooling the O-18 water after exiting the target cavity and before reintroduction.

Increased efficiency is obtained by periodically recharging the target loop with additional O-18 water without interrupting irradiation and using protons having an energy of about 16 Mev and an intensity of at least about 40 $\mu$A on the target cavity.

Rather than stop irradiation and loose cyclotron time, F-18 can be extracted from irradiated O-18 water in the target loop by periodically, e.g., every hour or two, briefly diverting the target loop through an F-18 extraction device without interrupting irradiation of the target cavity.

Because the amount of O-18 that is converted to F-18 is quite small, e.g., less than 0.1% of the O-18 is converted, after F-18 is extracted, the remaining O-18 water can be purified by solid phase purification devices and reintroduced into the target loop.

The aforementioned target loop can be implemented with, in order: an O-18 water reservoir; a pump; a target cavity; and a pressure regulator. The pump must be capable of generating the minimum desirable pressures of 250 psig and, for a typical target loop volume of 10 ml, a flow rate of 2 ml/min. Cooling of the O-18 water may be accomplished with a coil of tubing connected on the output side of the target cavity.

The F-18 may be recovered from some types of F-18 extraction devices with an eluant and a gas source for forcing the F-18 eluate into a delivery vial.

O-18 water purification devices are preferably connected through a valve to the output of the F-18 extraction device and may reintroduce O-18 water into the target loop by means of a simple check valve.

Production efficiency can be further increased by having a source vial with new O-18 water to periodically, without stopping irradiation, recharge the target loop as O-18 water is used up due to leakage and the like.

Valves and tubes are provided to controllably connect various elements to perform various functions to carry out the invention.

DETAILED DESCRIPTION

Figure 1:
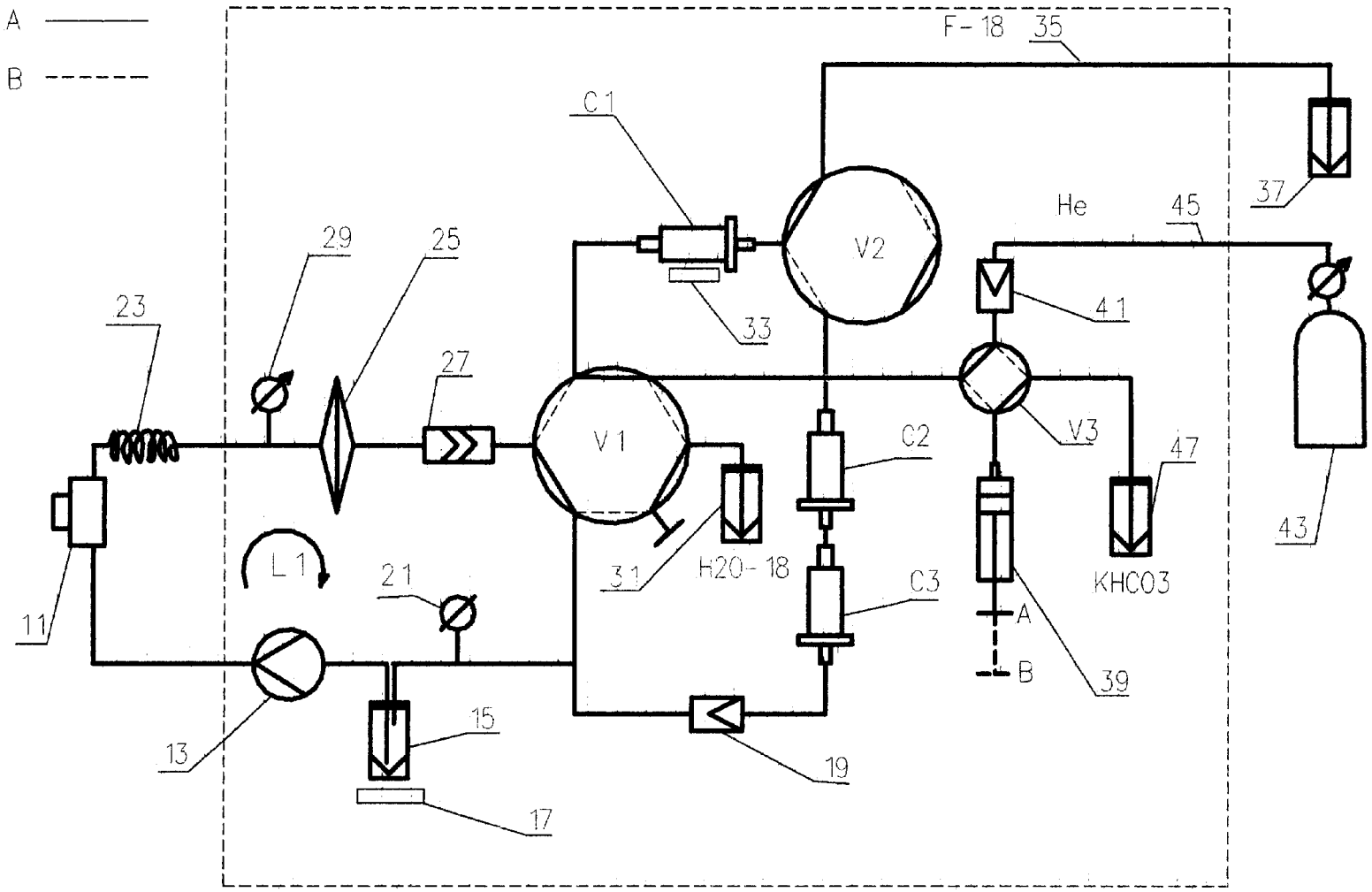
FIG. 1 is a schematic diagram of apparatus for practicing the invention.

FIG. 1 is a schematic diagram of the apparatus whose component parts will now be described. All of these are used in the field of High Pressure Liquid Chromatography (HPLC) where they are fairly common. Connections between components were made with either 1/16 in. (1.6 mm) OD type 316 stainless steel tubing or 1/16 in. (1.6 mm) OD, 0.030 in. (0.8 mm) ID polyetheretherketone (PEEK) tubing, as was mechanically convenient. The choice of tubing is believed to be not critical. PEEK compression fittings are used for both types of tubing.

The target 11 is the standard "high yield" cyclotron target supplied by General Electric (U.S.) PET Systems AB (Uppsala, Sweden). This target has a silver body with an 0.8 ml target volume behind a 1 cm diameter circular aperture covered with a cobalt alloy Havar™ (Co 42.5%, Cr 20%, Ni 13%, Fe/W/Mo/Mn) foil sealed with a crushed silver o-ring. Using standard components (not illustrated), the target body is cooled by 20 C water and the aperture foil is cooled with 50 psig (340 kPa) room temperature helium gas.

Use of PEEK fittings means that the target is electrically insulated from the remainder of the apparatus. Thus, the beam current absorbed by the target material can be measured with an ammeter (not shown) connected between the target 11 and the cyclotron ground.

The cyclotron used is a standard one from the target supplier and is not illustrated. It is a model PETtrace™ 2000 negative ion type that accelerates singly negatively charged hydrogen ions. The cyclotron produces a close to Gaussian beam of 16.5 MeV protons with a total beam current of up to 75 $\mu$A. As is usual, tungsten collimators are used to center a more uniform beam distribution in the 1 cm diameter target aperture. A carbon foil in the cyclotron beam strips electrons from the negatively charged hydrogen ions to produce protons (positively charged hydrogen ions).

The input to the target is supplied with O-18 water by a pump 13 that is in turn connected to a reservoir vial 15 with a capacity of about 5 ml. The pump is a Cole Palmer (Vernon Hills, Ill.) model U-07143-86 single piston type. This pump has a sapphire piston, ruby valve seats, gold-plated stainless steel springs, and type 317 stainless steel housings and fittings. Other wetted parts are made from non-reactive materials such as PEEK. The flow rate is set to about 5 ml/min.

A reservoir vial radiation sensor 17 is used to monitor radiation in the vial 15. This sensor is constructed with a 5 mm NaI scintillation crystal epoxied to a photodiode. (A PMT is not needed.) The assembly is within ½ in. (1.25 cm) of the vial 15, but a photocurrent amplifier (not illustrated) is located 10 feet (1 m) away to reduce the effects of a neutron flux generated by the irradiated target.

The input to the vial 15 comes from a valve V1 in parallel with an Upchurch (Oak Harbor, Wash.) model CV-3302 liquid check valve 19. This line is also connected to a Cole Palmer digital conductivity meter 21 having a micro-flow cell consisting of a 1/16 in. (1.6 mm) ID glass tube with embedded platinum electrodes.

Valve V1 is a Rheodyne (Rohnert Park, Calif.) model 7000 pneumatically actuated 6-port with two positions, A and B, indicated by the solid and dashed lines, respectively. In position A, 3 pairs of adjacent ports are connected, while in position B, the three other adjacent pairs are connected. As illustrated, one of the ports is sealed off. The pneumatic actuator gas lines are not illustrated.

The output of the target 11 goes through a cooling coil 23 that consists of 10 feet (3 m) of loose 2 in. (5 cm) dia coils of 1/16 in. (1.6 mm) OD stainless tubing. The cooling coil is essentially suspended in ambient air and provides cooling for water exiting the target 11. The coil is connected to an Alltech (Deerfield, Ill.) 10 micron stainless steel filter 25 that filters out, e.g., silver particles, that may have been picked up in the target. The filter is connected to an Upchurch model U-469 back pressure regulator 27 adjustable in the range of 250–500 psig (1.7–3.4 MPa). The pressure in the volume after the pump 13 is monitored by an Omega Engineering (Stamford, Conn.) model PX176-500 0–500 psig (0–3.4 MPa) pressure transducer 29. It is well know that higher pressures in the target volume increases the boiling point allowing higher intensity irradiation. However the present apparatus leaked at 500 psig (3.4 Mpa) and the maximum pressure could not be used.

When valve V1 is in the A position, the pump 13 circulates water through the target loop L1. Circulation is at the rate of about 5 ml/min. With a calculated loop volume of about 5 ml added to the reservoir vial 15 volume of 5 ml to yield 10 ml, this means that 2 minutes is required for one round trip.

The initial source of O-18 water is source vial 31 that is connected to one of the ports of valve V1. This vial has a 50 ml capacity. The concentration of the O-18 isotope is not necessarily 100%. Any concentration can be used, but in normal production, at least 80% and preferably higher should be used to reduce irradiation time and the cost of the cyclotron.

A Waters (Franklin, Mass.) model SepPak™ QMA cartridge C1 containing silica derivatized by quaternary ammonia is connected between the valve V1 and a second valve V2. This cartridge can adsorb F-18 ions from water. The F-18 can then be extracted using eluants such as 20–40 mM sodium or potassium carbonate in water or a water/acetonitrile mixture. The amount of F-18 in cartridge C1 is monitored by the photodiode sensor 33 adjacent to the cartridge.

Valve V2 is also a Rheodyne series 7000 pneumatically actuated 6-port with positions A and B as indicated by the solid and dashed line, respectively. Only half of this valve is used. One side of valve V2 is connected to an F-18 delivery line 35 constructed from 1/16 in. (1.6 mm) OD PEEK tubing stretching about 25 feet (8 m) from the cyclotron target area to an F-18 delivery vial 37.

The other side of valve V2 is connected to an in-line pair of deionizing cartridges C2 and C3 that are connected to the check valve 19. These are used to remove impurities from the O-18 water, especially in later stages of a production run. Cartridge C2 is an Alltech (Deerfield, Ill.) MaxiClean™ model SCX (Strong Cation Exchange) cartridge containing 600 mg of polystyrene resin derivatized with sulfonic acid. Cartridge C3 is a similar model SAX (Strong Anion Exchange) cartridge derivatized with a tetra-alkylammonium compound. Check valve 19 prevents back flow into these cartridges.

A third valve V3 is connected to valve V1. This is a model HVP-E 86779 4-port supplied by Alltech. One of these ports is connected to a Hamilton Gastight™ model 1002 2.5 ml syringe pump 39 (supplied by Alltech) with a pneumatically actuated plunger. The pump body is glass while the plunger is made from polytetrafluorethelyne with the trade name Teflon. As shown, the plunger has two extreme positions, all the way in, designated A, and all the way out, designated B.

Another port of valve V3 is connected to a gas check valve 41 that is connected to a remote helium tank 43 via helium line 45. The tank is filled with Matheson UHP grade 5.5 (i.e. 99.9995% pure) helium. The other port of valve V3 is connected to an eluant vial 47 containing a suitable eluant solution such as a sodium carbonate solution in water.

All components shown inside the dotted lines are mounted on and between two 8 in. (20 cm) wide by 14 in. (36 cm) high by ¼ in. (6 mm) thick aluminum plates separated by 6 in. (15 cm). This is about the same volume used by the standard liquid target filler apparatus supplied by the cyclotron manufacturer. This assembly is placed within 2–3' (60–90 cm) of the target 11. In addition to F-18 delivery line 35 and helium line 45, all other pneumatic actuator and electrical lines are brought outside the cyclotron radiation shield. While it would reduce the number of long lines to bring all components except the target loop L1 outside the shield, this would require a long line to the O-18 source vial 31 that would increase the possibility of contaminating the O-18 water.

The apparatus is operated under control of an IBM PC compatible computer and control system (not illustrated) based on an Omega Engineering (Stamford, Conn.) model CIO DAS 08 I/O board having analog and digital input and digital output ports. The output ports drive local solenoids that, in turn, drive pneumatic actuators located with the apparatus. In order to monitor operation, the computer also stores in memory readings from the pressure, radiation, and conductivity meters.

OPERATION

As noted above, production of F-18 for medical uses takes place in a work shift just preceding the beginning of a hospital day. Operation of the apparatus illustrated in FIG. 1 can be carried out with a series of runs that would typically last an hour or more. Before a run starts, it is necessary to make sure that the target loop L1 is filled with O-18 water. Then, a second production sequence of steps would produce F-18, extract the F-18 produced, and deliver it to the external vial 37 for further processing.

When the system is first assembled, the first requirement is to fill the target 11 and reservoir vial 15 with O-18 water. This is accomplished by connecting the vial of O-18 water 31 to valve V1. The three valves in the system and the syringe pump 39 are sequenced according to the following Table 1.

TABLE 1

Fill Target Loop Sequence

| Step | V1 | V2 | V3 | Syringe | Typical Time (s) |
|---|---|---|---|---|---|
| 1. Start | A | A | A | A (in) | — |
| 2. Fill Syringe | B | A | B | B (out) | 5 |
| 3. Switch Valves | A | B | B | B (out) | 5 |
| 4. Add Water | A | B | B | A (in) | 10 |
| 5. Purge Cartridges | A | B | A | A (in) | 5 |
| 6. Reset Valves | A | A | A | A (in) | 2 |

In the fill syringe step, O-18 vial 31 is connected through valves V1 and V2 to syringe 39. Then, when the syringe plunger is pulled out, O-18 water is pulled from the vial into the syringe.

In the switch valves step, the syringe is connected through valve V1 to cartridge C1 and through valve V2 to cartridges C2 and C3. In the add water step, the plunger of syringe 39 is pushed in and O-18 water is forced through the cartridges C1, C2, and C3 and check valve 19 into the reservoir vial 15. The volume and stroke of syringe 39 was adjusted to produce an injection of about 0.75 ml. The volume of the cartridges and connecting lines is about 1–2 ml.

This particular arrangement means that the initial charge of reservoir vial 15 as well as any subsequent recharges with O-18 water will be purified by the ion exchange cartridges C2 and C3.

In the purge cartridges step, Valve V3 connects the 50 psig (340 kPa) helium supply 43 via valve V1 to cartridge C1 and via valve V2 to cartridges C2, and C3. This purges the cartridges and forces any remaining water into reservoir vial 15. In the reset valves step, valve V2 is returned to the A position disconnecting cartridge C1 from cartridges C2 and C3, in preparation for either a repeat of the fill target sequence or the production sequence.

When a system is first assembled, the fill target sequence is repeated about 15 times to fill the loop L1, containing the target 11 and reservoir vial 15, with total of 10 ml of water. In the beginning of a work shift, the fill target sequence is repeated as necessary until reservoir vial 15 contains about 5 ml of water. After completion of the fill target sequences at the beginning of a work shift, the pump 13 and the cyclotron are turned on and left on for the remainder of the shift. Next is a production sequence of steps as listed in Table 2.

TABLE 2

| Production Sequence: | | | | | |
|---|---|---|---|---|---|
| Step | V1 | V2 | V3 | Syringe | Typical Time (s) |
| 1. Irradiation | A | A | B | A (in) | 300 and up |
| 2. Extraction | B | B | A | A (in) | 360 |
| 3. Purge | A | B | A | A (in) | 20 |
| 4. Fill Syringe | A | B | A | B (out) | 10 |
| 5. Prepare to Deliver | A | A | B | B (out) | 2 |
| 6. Elute F-18 | A | A | B | A (in) | 15 |
| 7. Deliver F-18 | A | A | A | A (in) | 240 |
| 8. Reset valves | A | A | B | A (in) | 1 |

During the Irradiation step, the cyclotron is turned on and the target 11 is irradiated. With valve V1 in the A position, pump 13 is running and circulates water through the target loop L1. Check valve 19 blocks circulation back into the cartridges C2 and C3. Back-pressure regulator 27 maintains the pressure at some level between 250–500 psig (1.7–3.4 MPa). Pressure monitor 29, that is upstream of the 10-micron filter 14, signals the control system if an over or under-pressure occurs. The conductivity monitor 21 signals the control system if the conductivity is too high, indicating excessive contamination. During irradiation, the amount of F-18 created is monitored by the reservoir vial radiation sensor 17 and associated circuitry.

With valve V3 in the B position, the helium supply pressurizes the eluant vial 47, but has no other effect. With valve V2 and the syringe 39 in the A position, there is no flow through the cartridge C1.

After a desired amount of F-18 has accumulated in the target, it is extracted. Valves V1 and V2 are switched to the B position breaking the loop L1 at valve V1 and forming a loop through the cartridges C1, C2, and C3. QMA cartridge C1 retains F-18 while deionizing cartridges C2 and C3 remove impurities from the water. After 360 sec about 85%90% of the F-18 has been absorbed on the cartridge.

The F-18 level in the QMA cartridge C1 is monitored by the photodiode 33 and the conductivity of the water is monitored by the photodiode 17.

In the purge step, as much O-18 water as possible is removed from the QMA cartridge C1. Valve V1 is switched to the A position connecting the cartridge through valve V3 to the helium source 43 and reestablishing the target loop L1. The helium gas pressure pushes water from the QMA cartridges through the deionizing cartridges C2 and C3 and past the check valve 19 into vial 15.

The next four steps deliver F-18 to the delivery vial 37. With valve V3 in the A position, the syringe 39 is connected to the eluant vial 47. Pulling the plunger out fills the syringe with about 0.75 ml of eluant. This takes about 10 seconds. Then, valve V2 is switched to the A position and valve V3 to the B position. This connects the syringe 39 to the QMA cartridge C1 and from there to the delivery vial 37. In the elute step, the plunger of the syringe 39 is pushed in over about a 15 second period. This forces eluant solution into the QMA cartridge C1.

Next, in the delivery step, valve C3 is switched to the A position so that the helium source 43 is connected to the QMA cartridge C1. The helium gas pressure forces the F-18 containing eluate into the delivery tube 35 and to the delivery vial 37. This takes about 240 seconds.

The recovery steps, starting with filling the syringe 39 and ending with delivery, are then repeated to accomplish complete removal of F-18 from the cartridge C1. About 85% of F-18 produced in the target 11 is removed from the QMA cartridge C1 after two extractions. This estimate is based on known target production efficiency as compared to the amount of F-18 delivered into the receiving vial 37.

A fraction of the remaining 15% of F-18 will be recovered in a subsequent production sequence depending on the length of the next run compared to the 109 minute F-18 half-life.

At the conclusion, valve V3 is switched back to position B to begin another production sequence or left in position A if the target loop L1 needs replenishing with water using the Fill Target sequence.

Four Working Examples

Four consecutive trial runs were made without shutting down the system using the same set of cartridges. Two sets of beam current amounts and irradiation times were used. The concentration of O-18 in the starting water was only 80% (because of the expense of higher concentrations). The eluant was 40 mM sodium carbonate solution in water. A Capintec (Ramsey, N.J.) 7BT dose calibrator was used to measure the amount of recovered F-18 after each run. The results appear in Table 3.

TABLE 3

| Four Trial Runs: | | | |
|---|---|---|---|
| Run #: | Beam Current (uA) | Irradiation Time (min) | Recovered F-18 (mCi) |
| 1 | 20 | 5 | 98 |
| 2 | 20 | 5 | 91 |
| 3 | 40 | 126 | 2240 |
| 4 | 40 | 104 | 2730 |

Runs 1 and 2 are too short to produce useful amounts of F-18, but were truncated to check system operation. In principal, the F-18 from many short runs can be combined, but this produces a very dilute solution of F-18. Therefore, a continuous run that delivers 2–4 Ci is preferred.

The higher amount of F18 delivered in run 4, despite a shorter irradiation time, is due to activity remaining in the target loop L1, including the target 11 and the reservoir vial 15, after run 3. There also were two extraction steps performed in run 4 as compared to one extraction step in run 3 which leads to a more complete extraction of the isotope. Further, it is not unusual with prior art static systems for recoveries to vary by 5–10% between otherwise identical runs.

Figure 2:
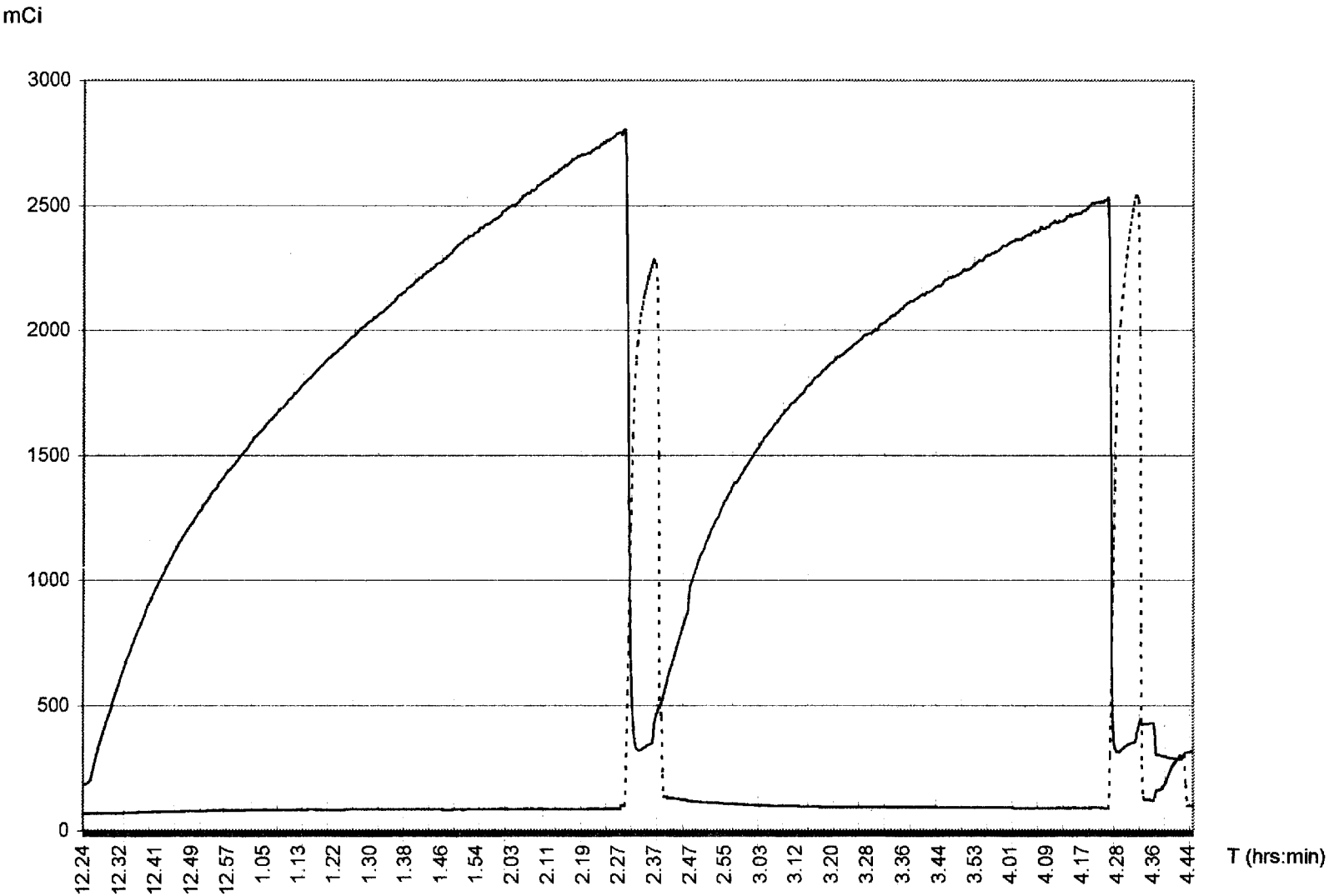
FIG. 2 is a graph of the reservoir vial and exchange cartridge radioactivity for two experimental runs.

For runs 3 and 4, FIG. 2 shows the radioactivity in the reservoir vial 15 and QMA cartridge C1 as determined by sensors 17 and 33, respectively, as a function of time, T, in hours and minutes. The output of these two sensors were scaled to approximate the recovered F-18. The only steps that are long enough to see on this scale of hours and minutes are irradiation, extraction and delivery.

At the beginning of run 3, radioactivity in the reservoir vial 15, indicated by the solid trace, builds up approximately exponentially because the irradiation time is comparable to F-18 's 1 hour and 49 minute half-life. At approximately 2:28, extraction starts and the amount of F-18 in the reservoir vial 15 drops rapidly with a corresponding increase in the QMA cartridge C1 indicated by the dotted line. The irradiation continues during the extraction step which is why F-18 amount is still rising when the elution step starts at approximately 2:38. This leaves some F-18, some of which is produced during extraction of run 3, in the reservoir vial 15 at the start of irradiation run 4.

Although not visible in the graphs because the Fill Target Loop Sequence takes less than 30 seconds, at the end of run 3, the target loop L1 was recharged with approximately 1.5 ml of O-18 water. This particular target was used for these experiments because it leaked too much to be used in a normal static target production run. The 1.5 ml added was an estimate based on a prior leak test without irradiation. The basic requirement is that the target 11 not run dry. This is fulfilled, if the out take tube of the reservoir vial 15 is always submerged. This is not difficult because, through experience, an estimate can be made of target loop water losses and the Fill Target Loop Sequence can be performed at any time as needed.

At approximately 4:19, at the end of radiation run 4, F-18 is extracted, but with greater apparent efficiency than after run 3. This is followed by a short delivery step and then a second extraction step ending just before the graph. What would have been Run 5 was terminated because cyclotron time allocated to the experiments ran out. It is believed that runs could have continued until the O-18 water in the source vial 31 ran out.

Figure 3:
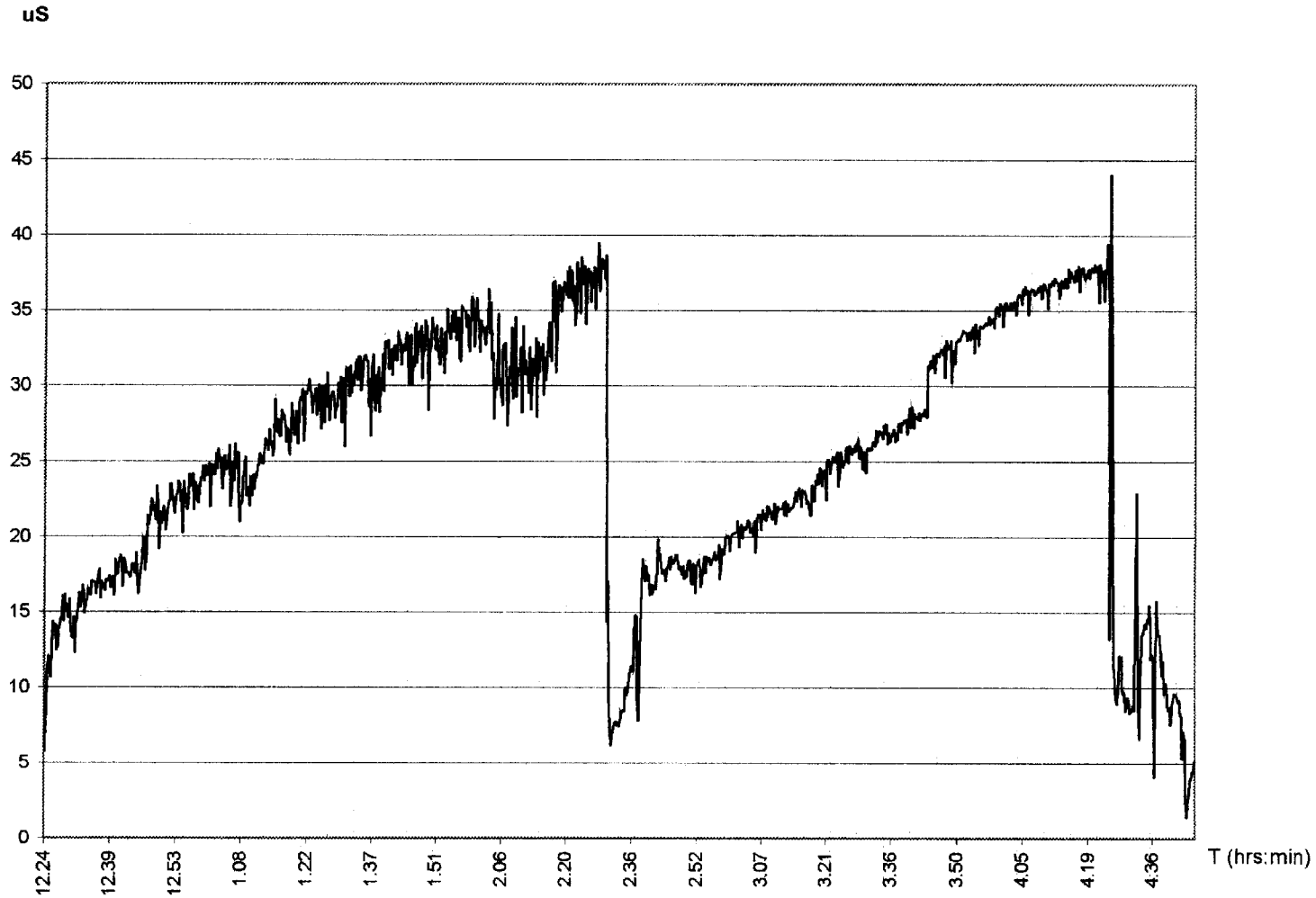
FIG. 3 is a graph of target water conductivity for the same runs as in FIG. 2.

FIG. 3 shows the target loop L1 water conductivity over the same time period as in FIG. 2. This increases with time due to the buildup of various ionic species produced mainly by target corrosion and decreases due to the SAX and SCX cartridges C2 and C3 during the extraction step. (Note that, F-18 does not contribute to conductivity changes because it is not present in chemically significant quantities.) The fact that the conductivity returns back to low levels after isotope extraction demonstrates the possibility of indefinite reuse of target material contained in the loop L1 and reservoir 15.

Figure 4:
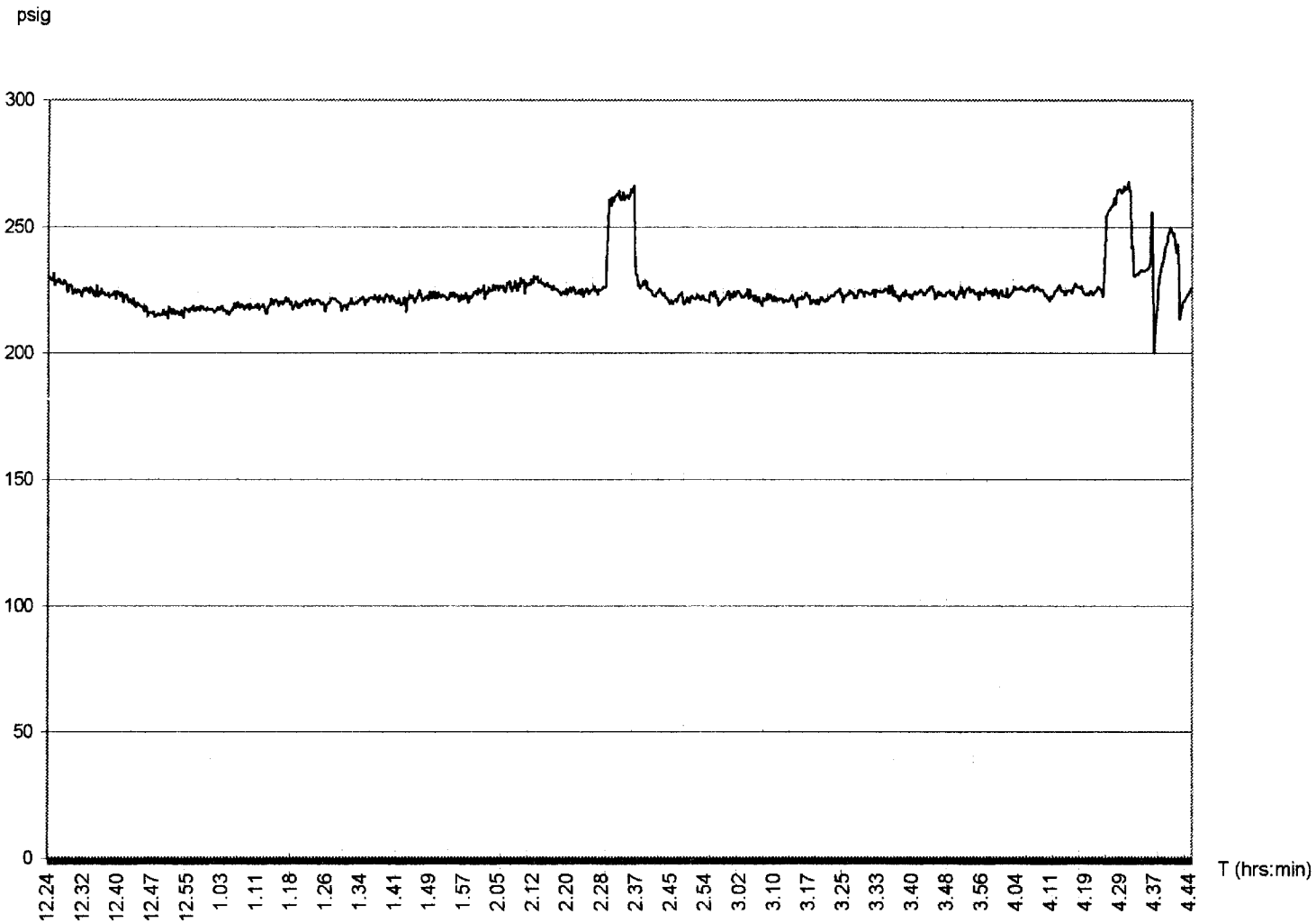
FIG. 4 is a graph of target water pressure for the same runs as in FIG. 2.

FIG. 4 shows the pressure in the target 11 over the same time period as in FIG. 2. It is held relatively constant by the pressure regulator with an increase when the target loop is diverted through the cartridges during extraction steps.

Alternative Approaches

The above example of operation and system description are provided to illustrate one of many ways to accomplish the recirculation and extraction. A variety of similar components may be used with equal success. For example, any high-pressure piston pump designed for HPLC or similar application and equipped with inert piston and check valves can be used to pump liquid. Similarly, a variety of valve designs are available that could be used to substitute Hamilton and Rheodyne valves provided that they utilize inert materials and are capable of sustaining the required pressure and are compatible with water.

Plumbing of the system can be substituted with all stainless steel or plastic material. Appropriate materials can be used to replace PEEK or type 316 stainless steel. Additional cooling of water removed from the target by means of a heat exchanger may be beneficial. Additional pressure, radioactivity and temperature sensors could provide better feedback and monitoring.

It may be beneficial to use increased water flow rates to provide better mixing inside the target and to achieve better heat dissipation. With higher water flow rates and additional cooling it may be possible to significantly increase beam current deposited into the target, thus increasing the isotope production rate. Thus, a recirculating target design has the potential to significantly increase production of the isotope.

The single syringe was a convenient device for transferring O-18 water and eluant. However, with a different valve arrangement, two syringes could be used or different fluid transfer devices substituted. For example, gas pressure could be used to force fluids out of containers.

A wide variety of commercially available cartridges designed for solid phase extraction and ion exchange can be used to substitute for QMA, SAX or SCX cartridges. Additional cartridges and filters can be installed as necessary to remove other potentially harmful impurities, such as a type C-18 cartridge to remove organic materials. Additionally, a sterilizing filter can be incorporated in a purification loop to remove microbial contamination, if necessary.

Various solutions can be used to remove extracted F-18 isotope from the QMA cartridge to accommodate requirements of the chemical processing that follow isotope production, as long as these solutions have sufficient ion strength to equilibrate the QMA cartridge and displace fluoride ion. For example, a solution of a tetraalkylammonium base or salt such as tetrabutyl ammonium carbonate or potassium carbonate in an equimolar mixture with a polycyclic aminopolyether such as 4,7,13,16,21,24-hexaoxa-1,10-diazabicyclo[8,8,8]hexacosane can be used to provide increased reactivity of F-18 fluoride in following nucleophilic substitution reactions. Such a solution can be used directly in the synthesis of some useful radiopharmaceutical agents such as [F18] 2-Deoxy-2-Fluoro-D-glucose, thus eliminating one step from the synthesis procedure and increasing yield and reducing synthesis time.

Lastly, the invention is not limited to using the particular target and cyclotron employed for the trial runs. Equivalents from other manufacturers should require only minor changes in apparatus.

It should therefore be clear that the detailed description of one working embodiment does not prevent inclusion of other equivalent embodiments within the purview of the invention that is defined by the following claims.

Applicant do not wish to avail themselves of 35 U.S.C. §112, ¶ 6 unless the phrase "means for' explicitly appears in a claim, as in claims 20 and 21 as originally filed.

What is claimed is:

1. A process of making an F-18 isotope comprising the steps of:

a) recirculating O-18 water through a target loop that includes a target cavity while irradiating said target cavity with protons to convert a portion of O-18 to F-18; and b) periodically diverting said recirculating O-18 water through extraction and purification devices so that said F-18 maybe extracted and said O-18 water may be purified for reuse in said target loop.

2. The process of claim 1 wherein said step a) is modified to include filtering said recirculating O-18 water with a mechanical filter.

3. The process of claim 1 wherein said extraction device is a deriviatized silica cartridge.

4. The process of claim 1 wherein said purification devices comprise a cation deionizing cartridge and an anion deionizing cartridge following said extraction device.

5. The process of claim 1 wherein said extraction device is a deriviatized silica cartridge followed by purification devices comprising at least one cation deionizing cartridge and at least one anion deionizing cartridge following said extraction device.

6. The process of claim 5 wherein said step a) is modified to include filtering said recirculating O-18 water with a mechanical filter.

7. A process of making an F-18 isotope comprising the steps of:

a) recirculating O-18 water through a target loop that includes a target cavity while irradiating said target cavity with protons to convert a portion of O-18 to F-18; and b) periodically recharging said target loop with additional O-18 water with recirculation and irradiation continuing during at least part of the time of recharging O-18 water.

8. The process of claim 7 wherein said step a) is modified to include filtering said recirculating O-18 water with a mechanical filter.

9. The process of claim 7 further comprising the step of: periodically extracting said F-18 from said recirculating O-18 water with recirculation and irradiation continuing during at least part of the time of extracting said F-18.

10. The process of claim 9 further comprising the step of: forcing said recirculating O-18 water through purification devices so that said O-18 water may be reintroduced into said target loop and reused.

11. The process of claim 7 further comprising the step of: forcing said recirculating O-18 water through purification devices so that said O-18 water may be reintroduced into said target loop and reused.

12. A process of making an F-18 isotope comprising the steps of:

a) recirculating O-18 water through a target loop that includes a target cavity while irradiating said target cavity with protons to convert a portion of O-18 to F-18; and b) periodically extracting said F-18 from said recirculating O-18 water with recirculation and irradiation continuing during at least part of the time of extracting said F-18.

13. The process of claim 12 wherein said step a) is modified to include filtering said recirculating O-18 water with a mechanical filter.

14. The process of claim 12 further comprising the step of: forcing said recirculating O-18 water through purification devices so that said O-18 water may be reintroduced into said target loop and reused.

15. The process of claim 14 wherein said step a) is modified to include filtering said recirculating O-18 water with a mechanical filter.

* * * * *